US010876697B2

(12) United States Patent
Murakami

(10) Patent No.: US 10,876,697 B2
(45) Date of Patent: Dec. 29, 2020

(54) VEHICLE LAMP

(71) Applicant: KOITO MANUFACTURING CO., LTD., Tokyo (JP)

(72) Inventor: Kazuomi Murakami, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/764,790

(22) PCT Filed: Nov. 1, 2018

(86) PCT No.: PCT/JP2018/040684
§ 371 (c)(1),
(2) Date: May 15, 2020

(87) PCT Pub. No.: WO2019/098041
PCT Pub. Date: May 23, 2019

(65) Prior Publication Data

US 2020/0363032 A1 Nov. 19, 2020

(30) Foreign Application Priority Data

Nov. 17, 2017 (JP) ..... 2017-221772

(51) Int. Cl.

| | |
|---|---|
| ***F21S 41/16*** | (2018.01) |
| ***F21S 41/20*** | (2018.01) |
| ***F21S 41/176*** | (2018.01) |
| ***F21V 5/00*** | (2018.01) |
| *F21S 41/25* | (2018.01) |
| *F21Y 115/30* | (2016.01) |

(52) U.S. Cl.
CPC ..... *F21S 41/285* (2018.01); *F21S 41/16* (2018.01); *F21S 41/176* (2018.01); *F21V 5/005* (2013.01);
(Continued)

(58) Field of Classification Search
CPC ..... F21S 41/16; F21S 41/25; F21S 41/285; F21V 5/004; F21V 5/005; F21V 5/008
(Continued)

(56) References Cited

U.S. PATENT DOCUMENTS

2005/0105301 A1 5/2005 Takeda et al.
2011/0249460 A1* 10/2011 Kushimoto ..... F21V 9/30 362/510
(Continued)

FOREIGN PATENT DOCUMENTS

DE 102014223933 A1 * 5/2016 ..... F21S 41/285
JP 2005150041 A 6/2005
(Continued)

OTHER PUBLICATIONS

International Search Report issued in International Application No. PCT/JP2018/040684, dated Jan. 22, 2019 (4 pages).
(Continued)

*Primary Examiner* — Christopher M Raabe
(74) *Attorney, Agent, or Firm* — Osha Bergman Watanabe & Burton LLP

(57) ABSTRACT

A vehicle lamp includes a laser light source unit, and an optical member configured to form a predetermined light distribution pattern with light emitted from the laser light source unit. The laser light source unit includes: at least one light source module including a laser light source configured to emit laser light, and a first lens configured to transmit the laser light; a wavelength conversion element configured to convert the laser light into white light and emit the converted white light; a second lens disposed between the light source module and the wavelength conversion element and configured to condense the laser light on the wavelength conver-
(Continued)

sion element; and a microlens array disposed between the second lens and the light source module and including a plurality of microlenses.

11 Claims, 8 Drawing Sheets

(52) U.S. Cl.
CPC ..... *F21V 5/008* (2013.01); *F21S 41/25* (2018.01); *F21Y 2115/30* (2016.08)

(58) Field of Classification Search
USPC ..... 362/510
See application file for complete search history.

(56) References Cited

U.S. PATENT DOCUMENTS

| | | | | |
|---|---|---|---|---|
| 2013/0027962 | A1* | 1/2013 | Takahashi | F21V 5/004 362/538 |
| 2015/0191115 | A1 | 7/2015 | Yamamura et al. | |
| 2016/0265733 | A1 | 9/2016 | Bauer et al. | |
| 2016/0290584 | A1 | 10/2016 | Nomura et al. | |
| 2016/0327235 | A1* | 11/2016 | Khrushchev | G02B 3/0062 |
| 2018/0059523 | A1* | 3/2018 | Takagi | G03B 33/08 |
| 2019/0024862 | A1 | 1/2019 | Kurashige et al. | |

FOREIGN PATENT DOCUMENTS

| | | | |
|---|---|---|---|
| JP | 2011129376 | A | 6/2011 |
| JP | 2016-197523 | A | 11/2016 |
| JP | 2016534503 | A | 11/2016 |
| WO | 2014002630 | A1 | 1/2014 |
| WO | 2017043531 | A1 | 3/2017 |

OTHER PUBLICATIONS

Written Opinion issued in International Application No. PCT/JP2018/040684, dated Jan. 22, 2019 (4 pages).

* cited by examiner

VEHICLE LAMP

TECHNICAL FIELD

The present disclosure relates to a vehicle lamp including a laser light source unit.

BACKGROUND ART

Patent Literature 1 discloses a vehicle lamp configured to control emitted light from a laser light source unit to form a predetermined light distribution pattern.

Specifically, Patent Literature 1 discloses a vehicle lamp configured to emit white light by causing laser light emitted from a short-wavelength laser light source to be incident on a wavelength conversion element.

In the laser light source unit disclosed in Patent Literature 1, the laser light emitted from the short-wavelength laser light source is condensed toward the wavelength conversion element by a condenser lens.

CITATION LIST

Patent Literature

Patent Literature 1: JP-A-2016-197523

SUMMARY OF INVENTION

Technical Problem

In the laser light source unit disclosed in Patent Literature 1, since intensity distribution of the laser light incident on the wavelength conversion element is close to Gaussian distribution, light intensity at a center portion of the laser light is fairly high, while light intensity at a peripheral portion of the laser light is fairly low. Therefore, it is difficult to sufficiently increase light-emission efficiency of the wavelength conversion element.

That is, in the laser light source unit disclosed in Patent Literature 1, it is difficult to obtain white light that has small color unevenness and that is suitable for light distribution control as the emitted light of the laser light source unit.

The present disclosure has been made in view of the above circumstances, and an object thereof is to provide a vehicle lamp that can obtain white light having little color unevenness and suitable for light distribution control.

Solution to Problem

A vehicle lamp according to an aspect of the present embodiment includes: a laser light source unit; and an optical member configured to form a predetermined light distribution pattern with light emitted from the laser light source unit. The laser light source unit includes: at least one light source module including a laser light source configured to emit laser light, and a first lens configured to transmit the laser light; an optical wavelength conversion element configured to convert the laser light into white light and emit the converted white light; a second lens disposed between the light source module and the optical wavelength conversion element, and configured to condense the laser light on the optical wavelength conversion element; and a microlens array disposed between the second lens and the light source module, and including a plurality of microlenses.

DESCRIPTION OF EMBODIMENTS

Hereinafter, a vehicle lamp 10 according to the present embodiment will be described with reference to the drawings.

Figure 1:
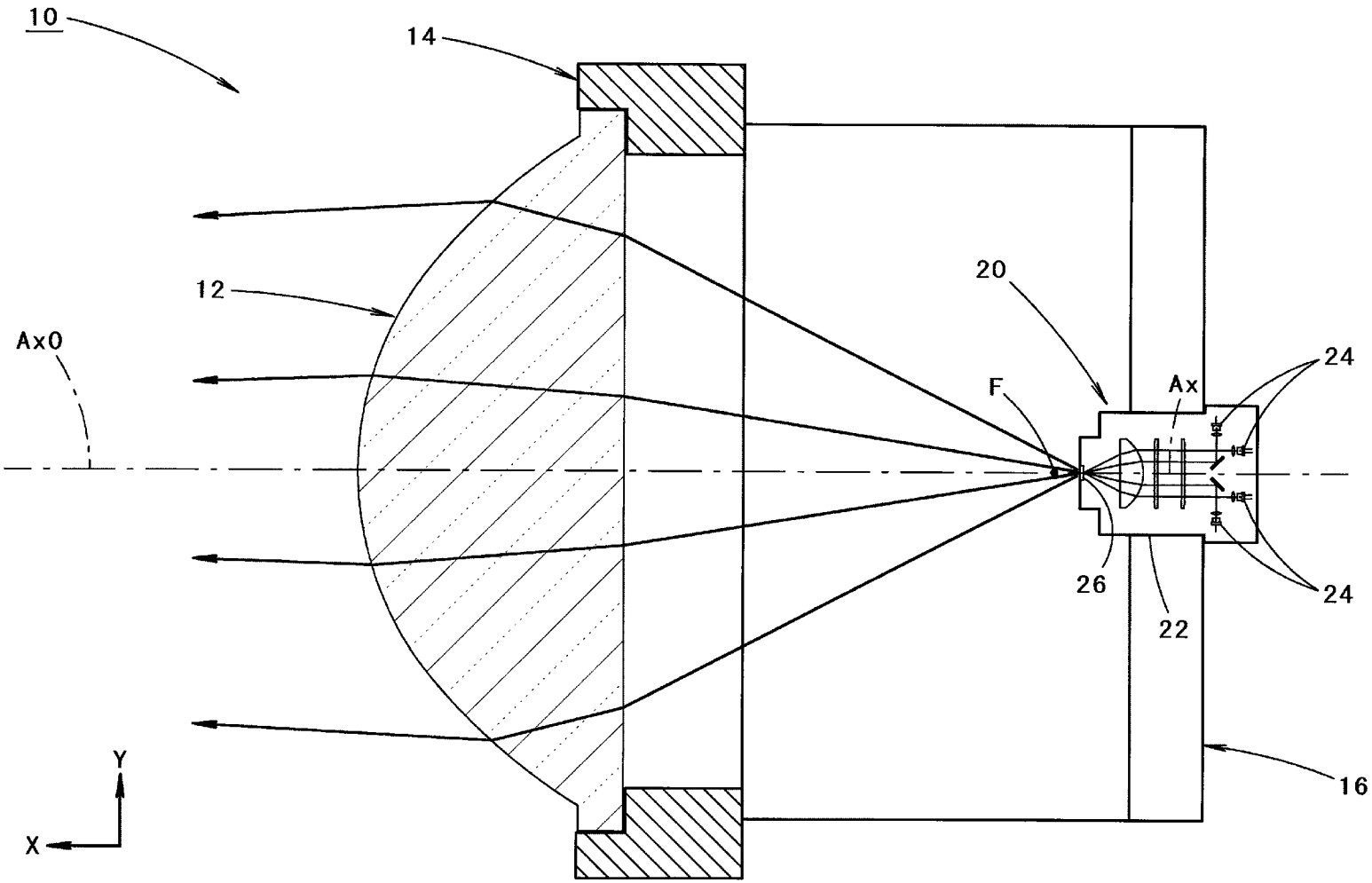
FIG. 1 is a plan sectional view showing a vehicle lamp according to the present embodiment.

FIG. 1 is a plan sectional view showing the vehicle lamp 10 according to the present embodiment.

In FIG. 1, a direction denoted by X indicates a "front side" of the lamp (also a "front side" of a vehicle), and a direction denoted by Y is a "right direction". The same applies to other figures.

As shown in FIG. 1, the vehicle lamp 10 according to the present embodiment is a projector lamp unit including a projection lens 12 having an optical axis Ax0 that extends in a front-rear direction of the vehicle, and a laser light source unit 20 disposed behind the projection lens 12. Light emitted from the laser light source unit 20 is radiated forward via the projection lens 12. Accordingly, a predetermined light distribution pattern is formed in front of the vehicle.

The projection lens 12 is a plano-convex aspherical lens including a convex front surface and a planar rear surface. A light source image formed on a rear-side focal plane, which is a focal plane including a rear-side focal point F of the projection lens 12, is projected on a virtual vertical screen in front of the lamp as an inverted image. The projection lens 12 is supported by a lens holder 14 at an outer peripheral flange portion of the projection lens 12. The lens holder 14 is supported by a base member 16.

The laser light source unit 20 is supported by the base member 16 in a state where the laser light source unit 20 is disposed behind the rear-side focal point F of the projection lens 12.

The laser light source unit 20 includes four short-wavelength laser light sources 24 arranged in a housing 22, and a wavelength conversion element 26 disposed in the housing 22. Laser light emitted from the short-wavelength laser light sources 24 is incident on the wavelength conversion element 26 to generate white light. The wavelength conversion element 26 emits the generated white light forward as diffused light.

The laser light source unit 20 has a radiation reference axis Ax that extends in a front-rear direction. In a state where the radiation reference axis Ax coincides with the optical axis Ax0 of the projection lens 12, the wavelength conversion element 26 is disposed near a rear side of the rear-side focal point F of the projection lens 12.

Figure 2:
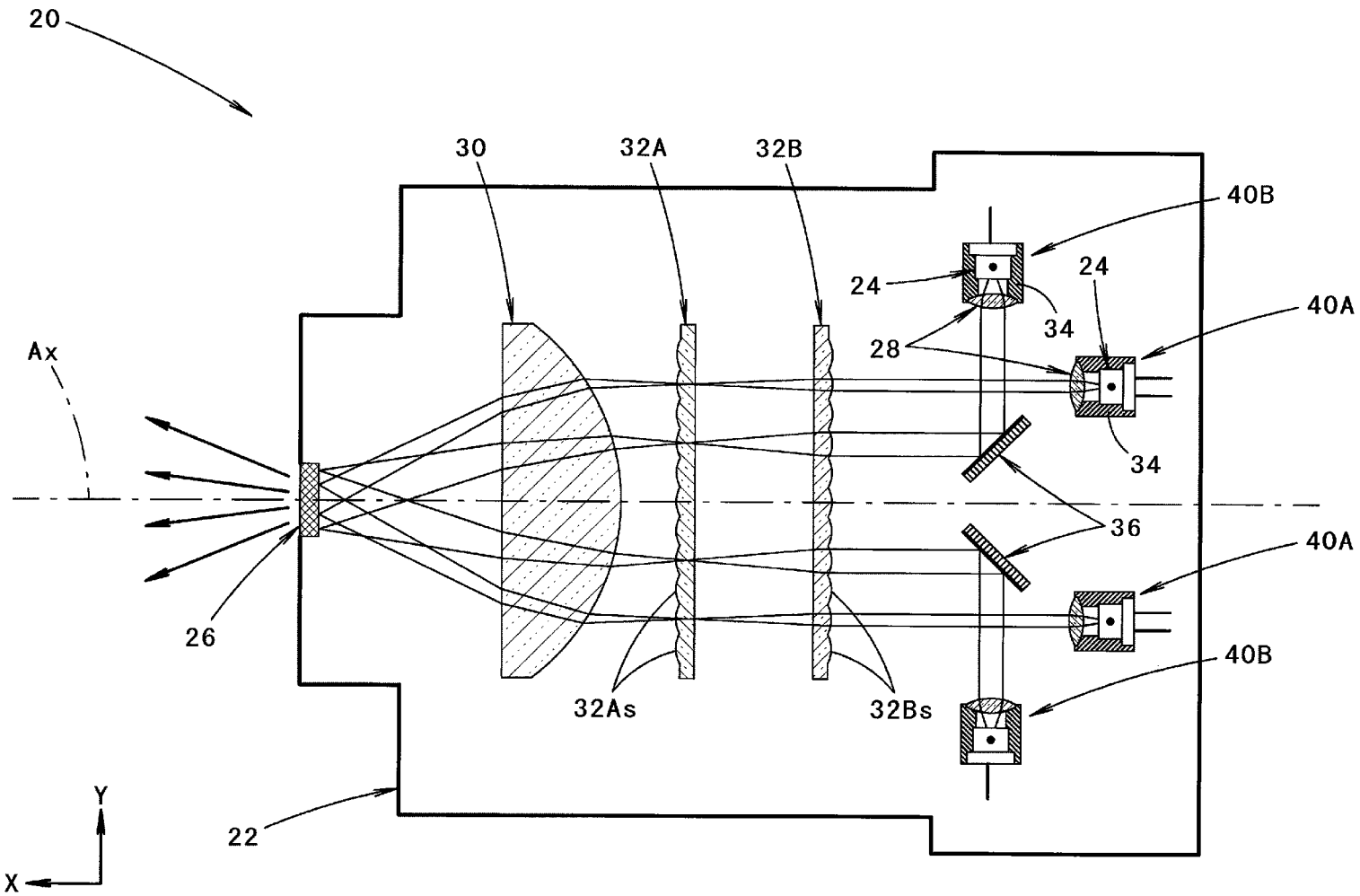
FIG. 2 is a plan sectional view showing a laser light source unit of the vehicle lamp.

FIG. 2 is a plan sectional view showing the laser light source unit 20 itself.

The laser light source unit 20 includes four first lenses 28 configured to condense the laser light respectively emitted from the short-wavelength laser light sources 24, a second lens 30 disposed between the four first lenses 28 and the wavelength conversion element 26, and two microlens arrays 32A and 32B arranged between the second lens 30 and the four first lenses 28.

The two microlens arrays 32A and 32B are arranged at a predetermined interval on the radiation reference axis Ax. The microlens array 32A positioned on a front side includes a transparent plate and a plurality of microlenses 32As formed in a lattice shape on a front surface of the transparent plate. The microlens array 32B positioned on a rear side includes a transparent plate and a plurality of microlenses 32Bs formed in the lattice shape on a rear surface of the transparent plate. Each of the microlenses 32As and 32Bs is formed as a fish-eye shaped lens element having a horizontally long rectangular outer shape.

The four short-wavelength laser light sources 24 have the same configuration, and the four first lenses 28 have the same configuration.

Each short-wavelength laser light source 24 is, for example, a laser diode configured to emit blue light. A light-emission wavelength band of the blue light is, for example, around 450 nm. Each first lens 28 is disposed near a light-emission position of a corresponding short-wavelength laser light source 24. The first lens 28 is configured to convert emitted light emitted from the short-wavelength laser light source 24 into substantially parallel light (that is, parallel light or light similar thereto). The short-wavelength laser light source 24 and the first lens 28 are supported by a lens barrel 34. Accordingly, each of two light source modules 40A and each of two light source modules 40B includes the short-wavelength laser light source 24, the first lens 28, and the lens barrel 34.

The two light source modules 40A are arranged to be bilaterally symmetrical with respect to the radiation reference axis Ax. Similarly, the two light source modules 40B are arranged to be bilaterally symmetrical with respect to the radiation reference axis Ax. The pair of left and right light source modules 40A are directed forward. The pair of left and right light source modules 40B are directed toward the radiation reference axis Ax. A mirror 36 is disposed between each light source module 40B and the radiation reference axis Ax to reflect emitted light from the light source module 40B (that is, laser light emitted from the short-wavelength laser light source 24 and converted into the substantially parallel light by the first lens 28) forward.

Emitted light from each light source module 40A directly reaches the microlens array 32B, while the emitted light from each light source module 40B reaches the microlens array 32B after being reflected by the mirror 36.

In FIG. 2, in each light source module 40A, emitted light from the short-wavelength laser light source 24 spreads in a horizontal transverse mode. In each light source module 40B, emitted light from the short-wavelength laser light source 24 spreads in a vertical transverse mode.

The second lens 30 is a plano-convex aspherical lens including a planar front surface and a convex rear surface. The second lens 30 is disposed on the radiation reference axis Ax. The second lens 30 is configured to condense laser light, which is emitted from the light source modules 40A and transmitted through the two microlens arrays 32A and 32B, on the wavelength conversion element 26.

The wavelength conversion element 26 includes a plate-shaped transparent seal member and a phosphor dispersed in the seal member. The laser light from the short-wavelength laser light sources 24 is incident on a rear surface of the wavelength conversion element 26 and then converted into the white light by the wavelength conversion element 26. Thereafter, the white light is diffused and emitted forward from a front surface of the wavelength conversion element 26. The wavelength conversion element 26 has a horizontally long rectangular outer shape. The wavelength conversion element 26 is fixed on a front end wall of the housing 22 on the radiation reference axis Ax.

In the laser light source unit 20 in the present embodiment, the short-wavelength laser light sources 24 and the microlens array 32A positioned on the front side are arranged in a conjugate positional relationship, and the microlens array 32B positioned on the rear side and the wavelength conversion element 26 are arranged in a conjugate positional relationship.

Figure 3:
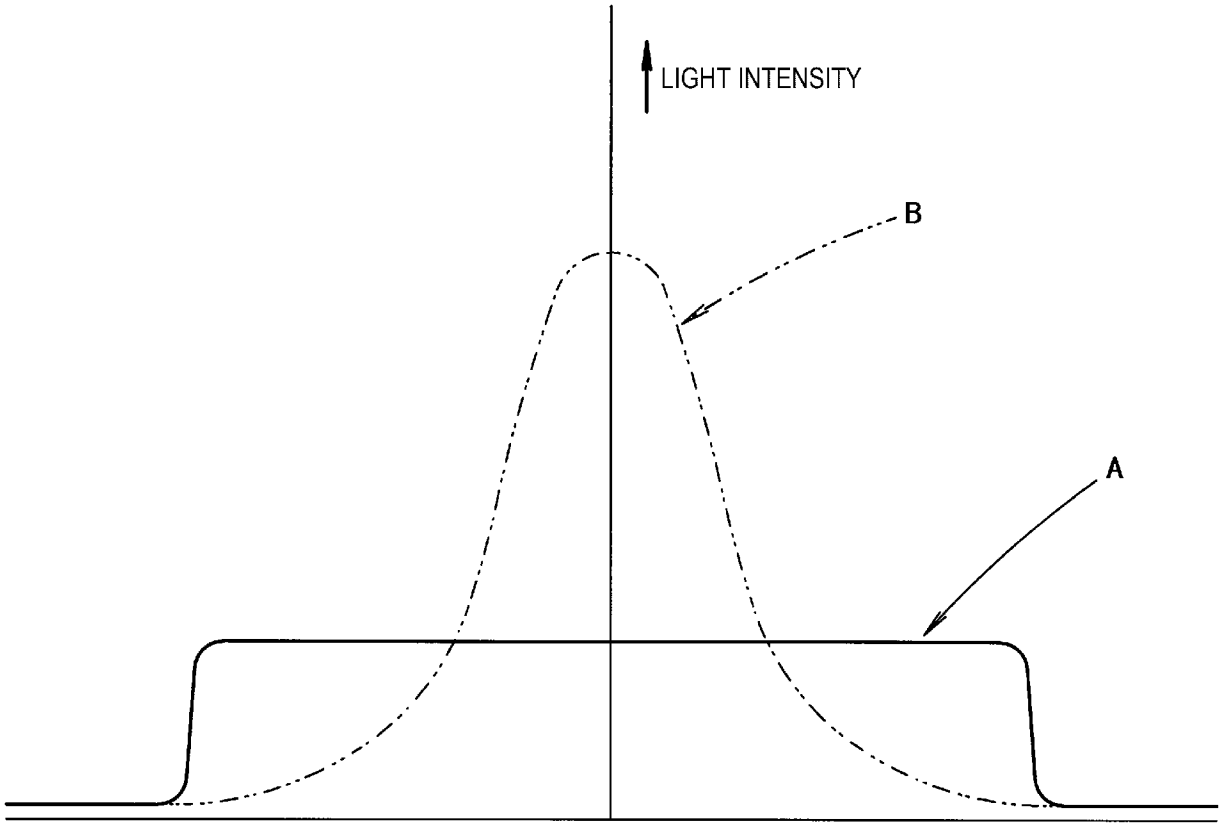
FIG. 3 is a diagram showing intensity distribution of laser light incident on a wavelength conversion element according to a related-art example and intensity distribution of laser light incident on a wavelength conversion element according to the present embodiment.

FIG. 3 is a diagram showing intensity distribution of laser light incident on the wavelength conversion element 26 according to a related-art example and intensity distribution of laser light incident on the wavelength conversion element 26 according to the present embodiment.

In the figure, intensity distribution A denoted by a solid line indicates the intensity distribution of the laser light in the present embodiment, while intensity distribution B denoted by a two-dot chain line indicates the intensity distribution of the laser light in the related-art example.

The intensity distribution B of the related-art example is intensity distribution of laser light in a case where laser light, emitted as the substantially parallel light from the four light source modules 40A and 40B, is condensed on the wavelength conversion element 26 via the second lens 30 without passing through the two microlens arrays 32A and 32B (that is, in a case where a general spatial multiplexing scheme is used).

The intensity distribution B is Gaussian distribution. That is, since the emitted light from the light source modules 40A and 40B is directly incident on the wavelength conversion element 26 via the second lens 30, the intensity distribution B becomes Gaussian distribution. Further, since the laser lights from the four short-wavelength laser light sources 24 are combined when being incident on the wavelength conversion element 26, light intensity of a center portion of a beam diameter is fairly high in the intensity distribution B.

On the other hand, the intensity distribution A in the present embodiment is nearly flat top-hat distribution over an entire region of a beam diameter of laser light incident on the wavelength conversion element 26. That is, since the two microlens arrays 32A and 32B and the second lens 30 constitute an integrator optical system, when the laser light from the short-wavelength laser light sources 24 is incident on the wavelength conversion element 26, the laser light becomes a beam having substantially uniform intensity distribution. Therefore, even when the laser lights from the four short-wavelength laser light sources 24 are combined when being incident on the wavelength conversion element 26, intensity distribution of the combined laser light is maintained as nearly flat distribution.

The intensity distribution of the laser light incident on the wavelength conversion element 26 is the nearly flat distribution, so that light-emission efficiency of the wavelength conversion element 26 is improved or maximized. Accordingly, the white light emitted forward from the wavelength conversion element 26 is substantially uniform diffused light having little color unevenness.

Figure 4:
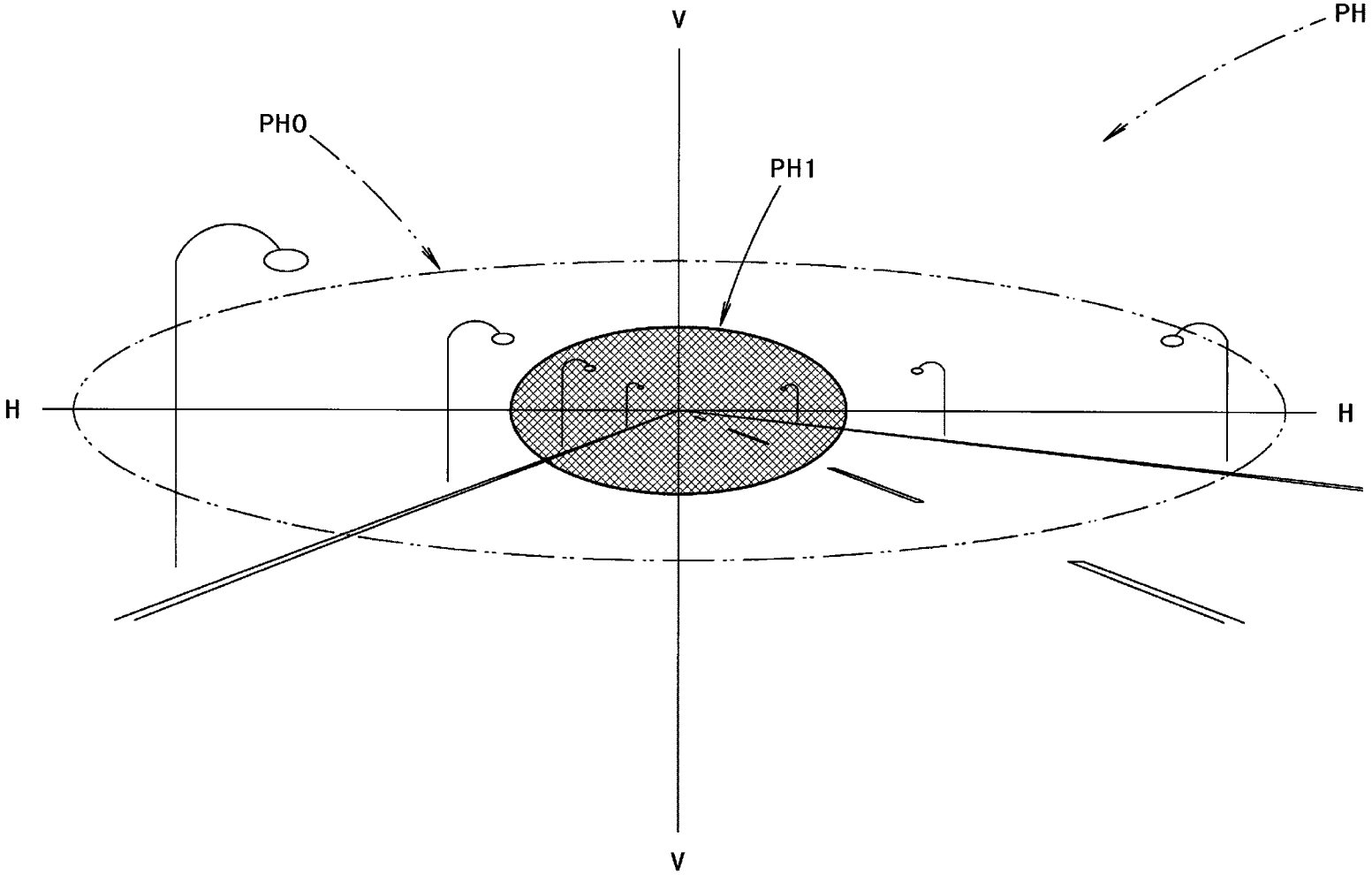
FIG. 4 is a diagram showing a light distribution pattern formed by radiation light from the vehicle lamp.

FIG. 4 perspectively shows a light distribution pattern PH1 formed on the virtual vertical screen disposed at a position 25*m* in front of the vehicle by light emitted forward from the vehicle lamp 10 according to the present embodiment.

The light distribution pattern PH1 is formed as a slightly horizontally long spot-shaped light distribution pattern centered on an H-V that is a vanishing point in a lamp front direction. The light distribution pattern PH1 is combined with a light distribution pattern PH0 formed by radiation light from another lamp unit (not shown), so as to form a high-beam light distribution pattern PH.

In the high-beam light distribution pattern PH, the light distribution pattern PH0 is formed as a diffusion light distribution pattern that largely spreads on both left and right sides around a V-V line that passes through the H-V in a vertical direction. The light distribution pattern PH1 is formed as a bright light distribution pattern that forms a high luminous intensity region of the high-beam light distribution pattern PH near the H-V.

Since the laser light source unit 20 emits the substantially uniform diffused light having little color unevenness, the light distribution pattern PH1 is also formed as a substantially uniform light distribution pattern having little color unevenness. A size of the light distribution pattern PH1 can be appropriately adjusted by displacing the laser light source unit 20 in the front-rear direction and changing an amount of rearward displacement from the rear-side focal point F of the wavelength conversion element 26 of the laser light source unit 20.

Next, operations and effects of the vehicle lamp 10 in the present embodiment will be described below.

In the laser light source unit 20 of the vehicle lamp 10 according to the present embodiment, the laser light emitted from the four short-wavelength laser light sources 24 is incident on the wavelength conversion element 26 so as to emit white light from the wavelength conversion element 26. The laser light source unit 20 includes the four first lenses 28 that convert the laser light emitted from the short-wavelength laser light sources 24 into the parallel light, the second lens 30 disposed between the four first lenses 28 and the wavelength conversion element 26, and the two microlens arrays 32A and 32B disposed between the second lens 30 and the four first lenses 28.

According to the above configuration, the laser light, which is emitted from the short-wavelength laser light sources 24 and converted into the parallel light by the first lenses 28, is incident on the wavelength conversion element 26 via the two microlens arrays 32A and 32B and the second lens 30. Therefore, the intensity distribution of the laser light incident on the wavelength conversion element 26 can be formed as the substantially flat distribution over the entire region of the beam diameter of the laser light.

Therefore, the light intensity can be made uniform over the entire region of the beam diameter as compared with the case where the intensity distribution of the laser light incident on the wavelength conversion element 26 is the substantially Gaussian distribution, so that the light-emission efficiency of the wavelength conversion element 26 can be increased.

Further, the emitted light from the laser light source unit 20 can be made as the white light having little color unevenness. That is, the emitted light is controlled by the projection lens 12 (light distribution control member), so that the light distribution pattern PH1 (predetermined light distribution pattern), which forms the high luminous intensity region of the high-beam light distribution pattern PH, can be formed as the substantially uniform light distribution pattern having little color unevenness.

As described above, the vehicle lamp 10 can be provided that can obtain the white light having little color unevenness and suitable for the light distribution control as the emitted light from the laser light source unit 20.

In the present embodiment, since the two microlens arrays 32A and 32B and the second lens 30, which are arranged in the serial positional relationship, constitute the integrator optical system, the intensity distribution of the laser light incident on the wavelength conversion element 26 can be easily formed as more flat distribution over the entire region of the beam diameter of the laser light. Further, even when the intensity distribution of the laser light emitted from the short-wavelength laser light sources 24 is irregular (for example, when the laser light has a multi-mode beam shape), the emitted light can be incident on the wavelength conversion element in a state where intensity of the laser light is made uniform over the entire region of the beam diameter.

Since the laser light source unit 20 includes the four short-wavelength laser light sources 24 and the four first lenses 28, brightness of light emitted from the vehicle lamp 10 can be increased.

In this respect, in a related-art laser light source unit, laser lights from the four short-wavelength laser light sources 24 are combined when being incident on the wavelength conversion element 26, so that light intensity of a center portion of a beam diameter of the laser light is fairly high. Therefore, the wavelength conversion element 26 may be broken.

On the other hand, in the laser light source unit 20 of the present embodiment, even when the laser lights from the short-wavelength laser light sources 24 are combined when being incident on the wavelength conversion element 26, the intensity distribution of the combined laser light is maintained as the nearly flat distribution. Therefore, the bright white light having little color unevenness can be obtained, and a possibility that the wavelength conversion element 26 is broken can be reduced or eliminated.

In the present embodiment, even in a case where the wavelength conversion element 26 comes off the housing 22, and laser light to be incident on the wavelength conversion element 26 from the short-wavelength laser light sources 24 is directly emitted from the laser light source unit 20, light intensity of the laser light is controlled to a certain value or less. Therefore, a situation can be prevented where an intense light beam is emitted forward.

In the present embodiment, laser light emitted from the two short-wavelength laser light sources 24 among the four short-wavelength laser light sources 24 is reflected by the mirrors 36 and then incident on the microlens array 32B. Therefore, the four short-wavelength laser light sources 24 can be arranged in the housing 22 with better space efficiency.

In the above-described embodiment, the microlenses 32As and 32Bs of the microlens arrays 32A and 32B have the horizontally long rectangular outer shape. However, the present embodiment is not limited thereto. For example, the outer shape of the microlenses 32As and 32Bs may be a square or a rhombus.

In the above-described embodiment, the microlenses 32As are formed on a front surface of the microlens array 32A, and the microlenses 32Bs are formed on a rear surface of the microlens array 32B. However, the present embodiment is not limited thereto. For example, the microlenses 32As may be formed on a rear surface of the microlens array 32A. Further, the microlenses 32Bs may be formed on a front surface of the microlens array 32B.

In the above-described embodiment, the laser light source unit 20 includes the four short-wavelength laser light sources 24, but the present embodiment is not limited thereto. The number of short-wavelength laser light sources 24 may be three or less, or five or more.

(First Modification)

Figure 5:
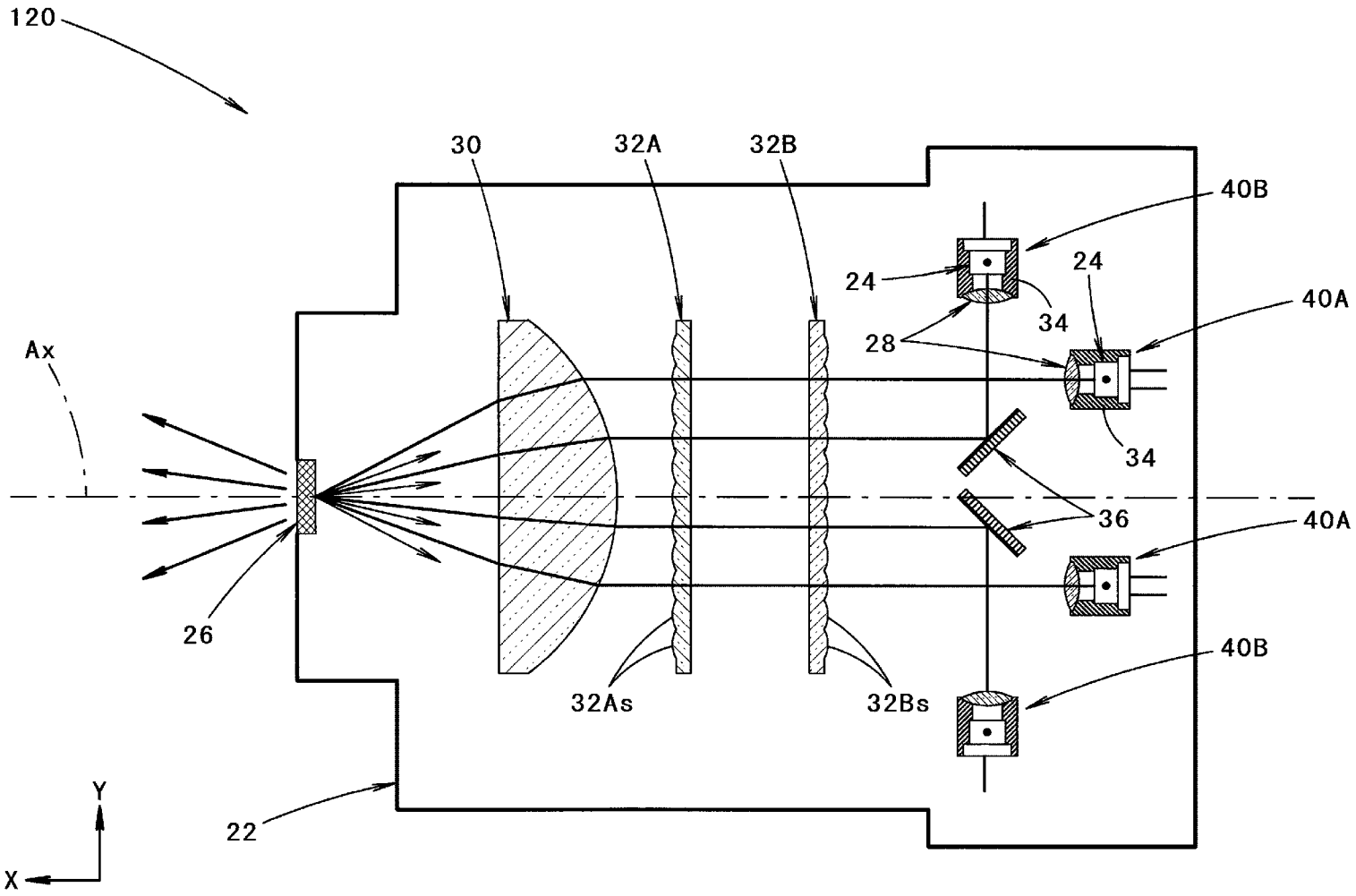
FIG. 5 is a plan sectional view showing a laser light source unit according to a first modification of the present embodiment.

Next, a laser light source unit 120 according to a first modification of the present embodiment will be described with reference to FIG. 5. FIG. 5 is a plan sectional view showing the laser light source unit 120 according to the first modification of the present embodiment.

As shown in FIG. 5, the laser light source unit 120 differs from the laser light source unit 20 in an arrangement of the light source module 40A and the mirror 36 that are positioned on a left side of the radiation reference axis Ax.

That is, in the present modification, an arrangement of the light source module 40A and the mirror 36 that are positioned on a right side of the radiation reference axis Ax is the same as that in the above embodiment. However, the light source module 40A and the mirror 36 that are positioned on the left side of the radiation reference axis Ax are arranged while being displaced in parallel and closer to the radiation reference axis Ax than in the above embodiment.

Accordingly, in the present modification, an optical path of light that is emitted from the light source module 40A positioned on the right side of the radiation reference axis Ax and that is directly directed to the microlens array 32B, and an optical path of light that is emitted from the light source module 40A positioned on the left side of the radiation reference axis Ax and that is directly directed to the microlens array 32B are bilaterally asymmetrical with respect to the radiation reference axis Ax. Further, an optical path of light that is emitted from the light source module 40B positioned on the right side of the radiation reference axis Ax, and that is reflected by the mirror 36 and then directed to the microlens array 32B, and an optical path of light that is emitted from the light source module 40B positioned on the left side of the radiation reference axis Ax, and that is reflected by the mirror 36 and then directed to the microlens array 32B are bilaterally asymmetrical with respect to the radiation reference axis Ax. However, as in a case of the above embodiment, intensity distribution of laser light incident on the wavelength conversion element 26 can be formed as nearly flat distribution over an entire region of a beam diameter of the laser light.

As the configuration of the present modification is adopted, a situation can be prevented where laser light from each of the light source modules 40A and 40B that is reflected by the wavelength conversion element 26 is incident on other light source modules 40A and 40B. Further, return light from the wavelength conversion element 26 can prevent oscillation operations of the short-wavelength laser light sources 24 of the light source modules 40A and 40B from becoming unstable, and prevent output fluctuations from being generated.

(Second Modification)

Figure 6:
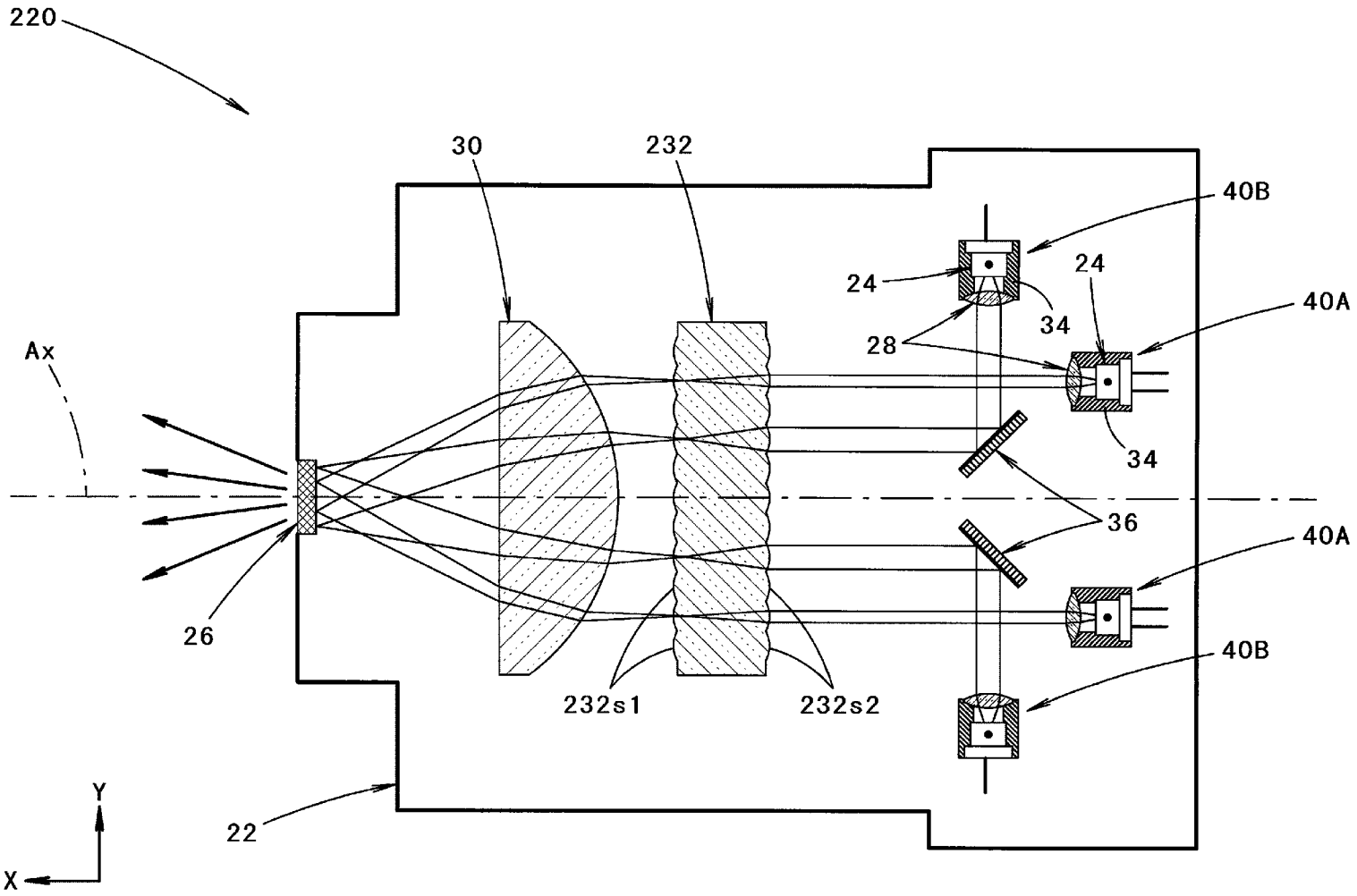
FIG. 6 is a plan sectional view showing a laser light source unit according to a second modification of the present embodiment.

Next, a laser light source unit 220 according to a second modification of the present embodiment will be described with reference to FIG. 6. FIG. 6 is a plan sectional view showing the laser light source unit 220.

As shown in FIG. 6, the laser light source unit 220 differs from the laser light source unit 20 in that a block-shaped microlens array 232 is adopted instead of the two microlens arrays 32A and 32B.

The microlens array 232 includes a thick transparent plate, a plurality of microlenses 232*s*1 formed in a lattice shape on a front surface of the transparent plate, and a plurality of microlenses 232*s*2 formed in the lattice shape on a rear surface of the transparent plate. A plate thickness of the microlens array 232 has a value smaller than that of a front-rear width of all two microlens arrays 32A and 32B (see FIG. 2). The microlens array 232 has the same optical function as those of the two microlens arrays 32A and 32B.

That is, in the laser light source unit 220, the short-wavelength laser light sources 24 and the microlenses 232*s*1 of the microlens array 232 are arranged in a conjugate positional relationship, and the microlenses 232*s*2 of the microlens array 232 and the wavelength conversion element 26 are arranged in a conjugate positional relationship.

The laser light source unit 220 in the present modification can obtain the same operations and effects as those of the laser light source unit 20 in the present embodiment.

In the microlens array 232, since the two microlens arrays 32A and 32B are integrally formed in the block shape, accuracy of a positional relationship therebetween can be improved, and the number of components of the laser light source unit 220 can be reduced.

(Third Modification)

Figure 7:
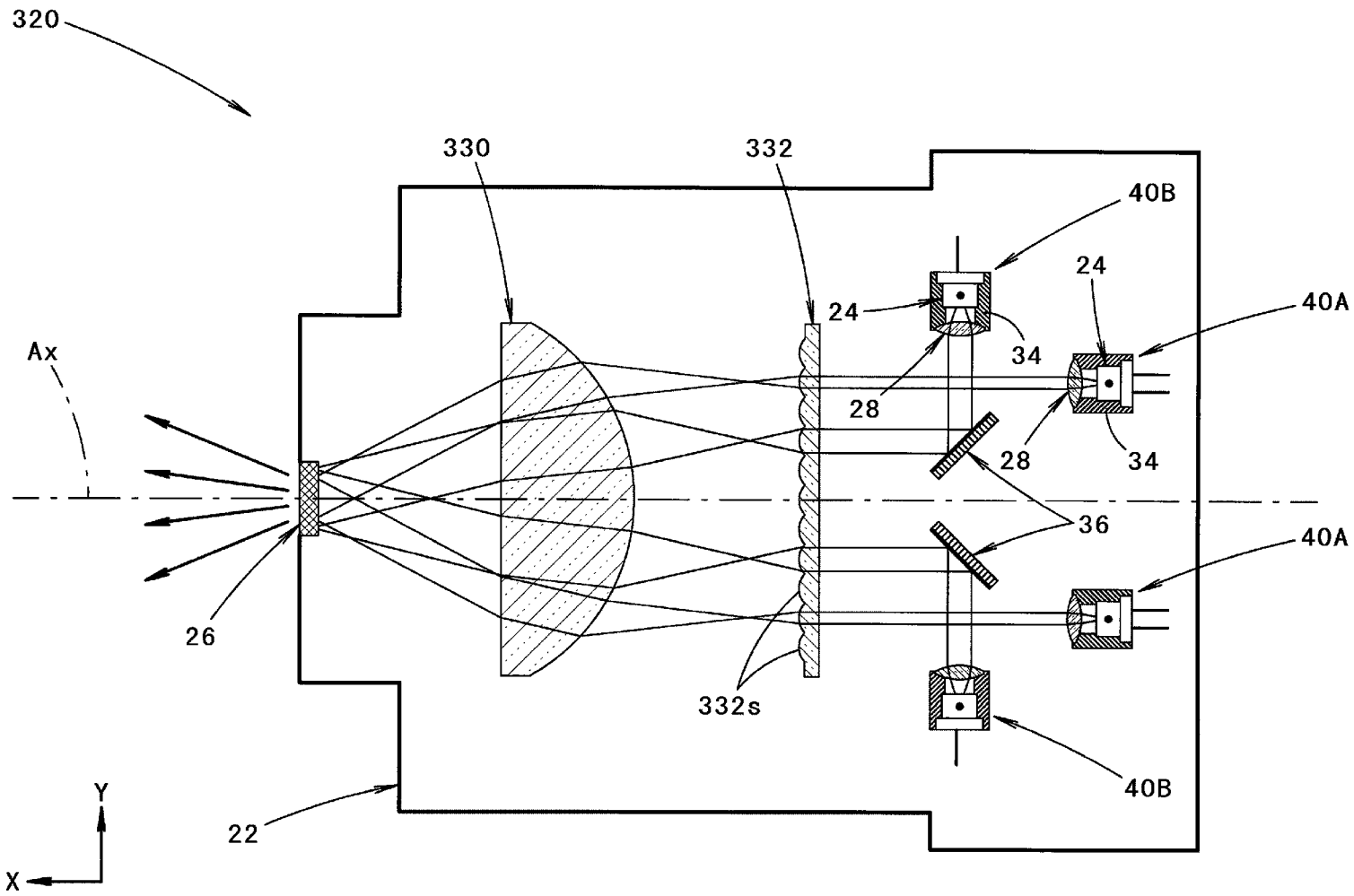
FIG. 7 is a plan sectional view showing a laser light source unit according to a third modification of the present embodiment.

Next, a laser light source unit 320 according to a third modification of the present embodiment will be described with reference to FIG. 7. FIG. 7 is a plan sectional view showing the laser light source unit 320 in the present modification.

As shown in FIG. 7, the laser light source unit 320 differs from the laser light source unit 20 in that one microlens array 332 is adopted instead of the two microlens arrays 32A and 32B.

The microlens array 332 has substantially the same configuration as that of the microlens array 32A in the above embodiment. That is, the microlens array 332 includes a transparent plate, and a plurality of microlenses 332*s* formed in a lattice shape on a front surface of the transparent plate.

In the laser light source unit 320 in the present modification, the microlens array 332 and the wavelength conversion element 26 are arranged in a conjugate positional relationship, and emitted light from the second lens 330 is incident on the wavelength conversion element 26 as substantially parallel light.

In order to implement the above configuration, in the microlens array 332, a focal distance of the microlenses 332*s* has a value smaller than a focal distance of the microlenses 32*s* in the above embodiment. Further, the microlens array 332 is disposed at substantially the same position as a position where the microlens array 32B in the above embodiment is disposed. Further, as the second lens 330, a condenser lens is used which has a focal distance shorter than that of the second lens 30 in the above embodiment.

The laser light source unit 320 in the present modification can obtain the same operations and effects as those of the laser light source unit 20 in the present embodiment. Further, the number of components of the laser light source unit 320 can be reduced.

(Fourth Modification)

Figure 8:
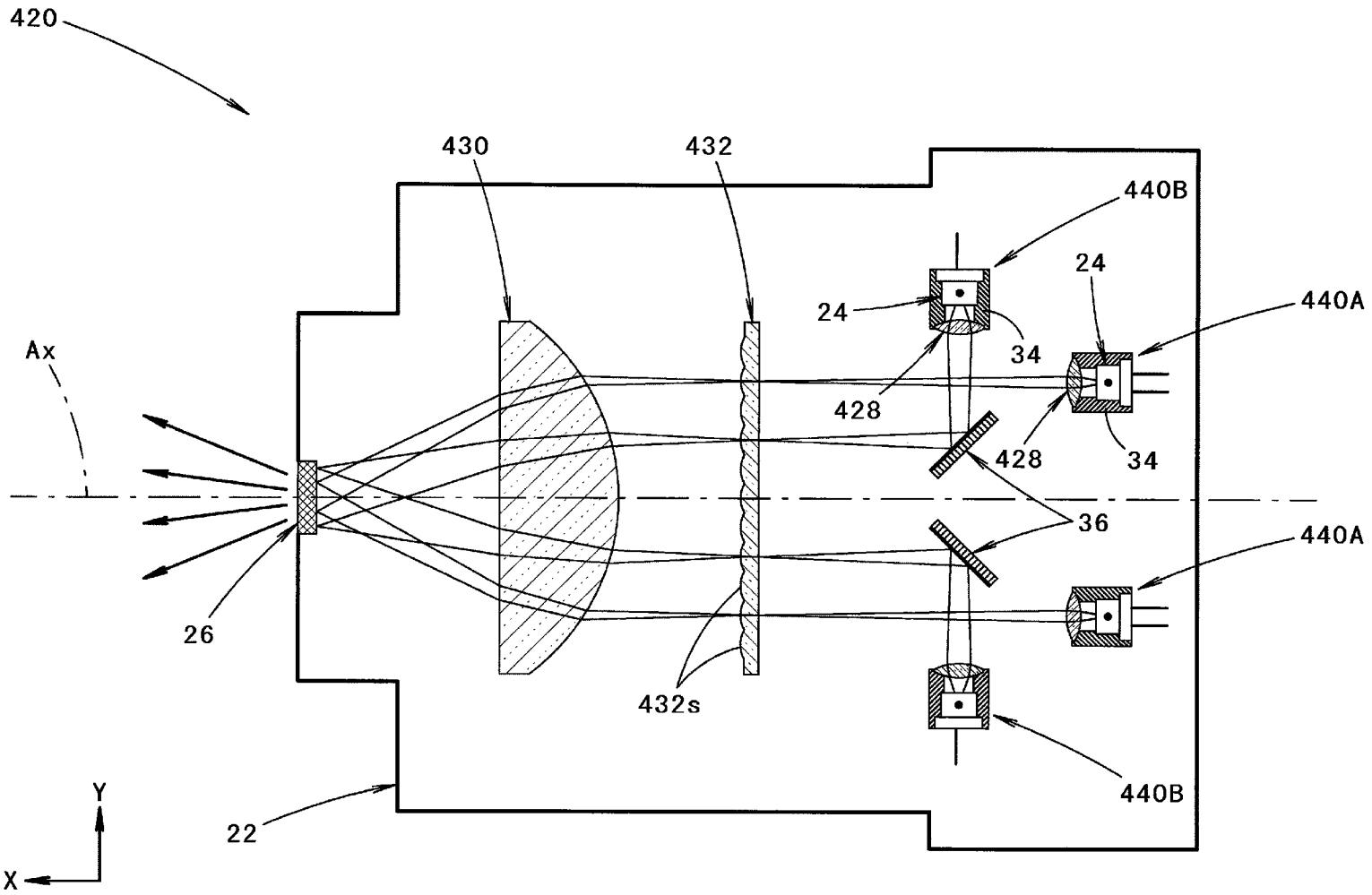
FIG. 8 is a plan sectional view showing a laser light source unit according to a fourth modification of the present embodiment.

Next, a laser light source unit 420 according to a fourth modification of the present embodiment will be described with reference to FIG. 8. FIG. 8 is a plan sectional view showing the laser light source unit 420 in the present modification.

As shown in FIG. 8, the laser light source unit 420 differs from the laser light source unit 20 in that one microlens array 432 is adopted instead of the two microlens arrays 32A and 32B.

The microlens array 432 has substantially the same configuration as that of the microlens array 32A in the above embodiment. That is, the microlens array 432 includes a transparent plate, and a plurality of microlenses 432*s* formed in a lattice shape on a front surface of the transparent plate. The laser light source unit 220 in the present modification can obtain the same operations and effects as those of the laser light source unit 20 in the present embodiment. The microlens array 432 is positioned substantially at a center of a distance between the microlens array 32A and the microlens array 32B. In other words, a distance between the microlens array 432 and the microlens array 32A is substantially equal to a distance between the microlens array 432 and the microlens array 32B.

In the laser light source unit 420 in the present modification, the short-wavelength laser light sources 24 and the microlens array 432 are arranged in a conjugate positional relationship, and first lenses 428 and the wavelength conversion element 26 are arranged in a conjugate positional relationship.

The first lenses 428 of the light source modules 440A and 440B convert emitted light from the short-wavelength laser light sources 24 into light that converges slightly more than parallel light. Light reflected by the mirrors 36 is condensed at a position of the microlens array 432. In particular, in order to make an optical path length from each light source module 440A to the microlens array 432 and an optical length from each light source module 440B to the microlens array 432 coincide with each other, the light source modules 440B and the mirrors 36 are displaced toward a front side as compared with a case of the above embodiment, and the light source modules 440B are also displaced toward an radiation reference axis Ax side.

The laser light source unit 420 in the present modification can obtain the same operations and effects as those of the laser light source unit 20 in the present embodiment. Further, the number of components of the laser light source unit 420 can be reduced.

In this modification, the configuration of the microlens array 432 may be the same as the configuration of the microlens array 32A in the above embodiment. Further, the configuration of the second lens 430 may be the same as that of the second lens 30 in the above embodiment.

In the third and fourth modifications, the microlenses 332*s* and 432*s* may be formed on the rear surfaces of the microlens arrays 332 and 432.

Although the embodiment of the present invention has been described, the technical scope of the present invention should not be restrictively construed based on the description of the embodiment. The present embodiment is merely exemplary, and a person skilled in the art should appreciate that various modifications can be made to the embodiment within the scope of the invention recited in the claims. The technical scope of the present invention should be determined based on the scope of the invention recited in the claims and equivalents thereof.

The entire contents described in Japanese Patent Application (Patent Application No. 2017-221772) filed on Nov. 17, 2017 are incorporated herein by reference.

The invention claimed is:

1. A vehicle lamp comprising:

a laser light source unit; and an optical member configured to form a predetermined light distribution pattern with light emitted from the laser light source unit, wherein the laser light source unit includes:

at least one light source module including a laser light source configured to emit laser light, and a first lens configured to transmit the laser light;

an optical wavelength conversion element configured to convert the laser light into white light and emit the converted white light;

a second lens disposed between the light source module and the optical wavelength conversion element and configured to condense the laser light on the optical wavelength conversion element; and a microlens array disposed between the second lens and the light source module and including a plurality of microlenses.

2. The vehicle lamp according to claim 1, wherein the microlens array includes:

a first microlens array including a first transparent plate, and a plurality of first microlenses formed on a front surface of the first transparent plate; and a second microlens array including a second transparent plate, and a plurality of second microlenses formed on a rear surface of the second transparent plate, and wherein the first microlens array and the second microlens array are separated from each other.

3. The vehicle lamp according to claim 1, wherein the microlens array includes a third transparent plate, a plurality of third microlenses formed on a front surface of the third transparent plate, and a plurality of fourth microlenses formed on a rear surface of the third transparent plate.

4. The vehicle lamp according to claim 1, wherein the light source module includes a plurality of light source modules.

5. The vehicle lamp according to claim 4, wherein the light source module includes:

a first light source module disposed on one side of a radiation reference axis of the light source unit; and a second light source module disposed on the other side of the radiation reference axis, and wherein the first light source module and the second light source module are symmetrically arranged with respect to the radiation reference axis.

6. The vehicle lamp according to claim 4, wherein the light source module includes:

a first light source module disposed on one side of a radiation reference axis of the light source unit; and a second light source module disposed on the other side of the radiation reference axis, and wherein the first light source module and the second light source module are asymmetrically arranged with respect to the radiation reference axis.

7. The vehicle lamp according to claim 1, wherein the first lens is configured to convert the laser light into parallel light.

8. The vehicle lamp according to claim 1, wherein the laser light source unit further includes a mirror disposed on an optical path between the light source module and the microlens array and configured to reflect laser light emitted from the first lens toward the microlens array.

9. The vehicle lamp according to claim 1, wherein the plurality of microlenses are arranged in a lattice shape.

10. The vehicle lamp according to claim 4, wherein the light source module includes:

a first light source module disposed on one side of a radiation reference axis of the light source unit;

a second light source module disposed on the one side;

a third light source module disposed on the other side of the radiation reference axis; and a fourth light source module disposed on the other side, and wherein the laser light source unit further includes:

a first mirror disposed on an optical path between the first light source module and the microlens array and configured to reflect laser light emitted from the first light source module toward the microlens array; and a second mirror disposed on an optical path between the third light source module and the microlens array and configured to reflect laser light emitted from the third light source module toward the microlens array.

11. The vehicle lamp according to claim 10, wherein laser light emitted from the second light source module and laser light emitted from the fourth light source module are directly incident on the microlens array.

* * * * *